US005878299A

United States Patent [19]

Kopp et al.

[11] Patent Number: 5,878,299

[45] Date of Patent: Mar. 2, 1999

[54] METHOD FOR THE OPERATION OF A PRINTING MECHANISM IN AN ELECTROGRAPHIC PRINTER OR COPIER

[75] Inventors: Walter Kopp, Taufkirchen; Hans Winter, Munich; Edmund Creutzmann, Markt Schwaben, all of Germany

[73] Assignee: Oce Printing Systems GmbH, Germany

[21] Appl. No.: 990,337

[22] Filed: Dec. 15, 1997

[30] Foreign Application Priority Data

Dec. 18, 1996 [DE] Germany ..... 196 52 861.5

[51] Int. Cl.[6] ..... G03G 15/08

[52] U.S. Cl. ..... 399/53; 399/267

[58] Field of Search ..... 399/53, 54, 55, 399/56, 58, 59, 60, 64, 267, 258, 252

[56] References Cited

U.S. PATENT DOCUMENTS 5,430,528 7/1995 Kumasaka et al. ..... 399/267

FOREIGN PATENT DOCUMENTS 42 32 232 4/1995 Germany .

*Primary Examiner*—Matthew S. Smith
*Assistant Examiner*—Hoan Tran
*Attorney, Agent, or Firm*—Hill & Simpson

[57] ABSTRACT

A method for operation of a printing mechanism in an electrographic printer or copier, whereby a charge image is applied at a surface region of a toner image carrier. The surface region provided with the charge image is conveyed past at the transfer surface of a transfer element at a spacing of a developing gap. The actual width of the gap is controlled with a loop control circuit.

10 Claims, 4 Drawing Sheets a)

b)

METHOD FOR THE OPERATION OF A PRINTING MECHANISM IN AN ELECTROGRAPHIC PRINTER OR COPIER

BACKGROUND OF THE INVENTION

The invention is directed to a method for the operation of a printing mechanism in an electrographic printer or copier, whereby a charge image is applied at the surface region of a toner image carrier. The surface region provided with the charge image is conveyed past the transfer surface of a transfer element at the spacing of a development gap, so that toner is transferred from the transfer surface to the surface of the toner image carrier.

The width of the developing gap is essentially determined by the spacing between toner image carrier and transfer surface of the transfer element. Different demands are made of the allowable width of the developing gap dependent on the printing or copying method employed. Applied, among other things, are electrophotographic methods, electromagnetic methods and inographic methods. Single-component and multi-component toners are employed as the toner. Liquid and solid toner are also distinguished.

In a known method, a relatively constant width of the developing gap is achieved in that the transfer surface is pressed against the surface of the toner image carrier by a pressing mechanism. The developing gap spacing can be prescribed via a spacer that, for example, rolls along on the toner image carrier with the assistance of rollers.

What is disadvantageous about this solution is that the rollers and the photoconductor as well are exposed to increased wear due to this type of spacing regulation. With increasing wear, however, the spacing is no longer held constant to the required extent.

DE 42 32 232 C2 discloses a method for setting the width of a developing gap, whereby an average gap width is set before the beginning of the printing process with a control circuit, without taking the radial deviation of a photoconductor drum into consideration. The radial deviation is then compensated during the printing process via a controller that employs a data bank having permanently prescribed data.

SUMMARY OF THE INVENTION

An object of the invention is to specify a method for the operation of a printing mechanism that allows a low-wear and exact setting of the width of the developing gap.

For a method of the type initially cited, this object is achieved in that the actual width of the gap changing when the surface region of the photoconductor is conveyed past is acquired. An error signal is subsequently formed from the actual width and from a predetermined rated width of the gap, this error signal being a criterion for the deviation between actual width and rated widths. Dependent on the error signal, the width of the gap is set by an adjustment unit of a closed loop such that the error signal is reduced in terms of amount.

In the invention, a closed loop is employed for setting the width of the developing gap. The control can be implemented both circuit-oriented as well as software-oriented, whereby the control is operated step-by-step, given a software-oriented solution.

The employment of a closed loop is particularly justified when an extremely great number of pages must be printed per minute in continuous operation.

Since no idle times or only short idle times occur, the wear, given use of the invention, is substantially reduced compared to the known adjustment of the developing gap. For example, high page performances are demanded in high-performance printers wherein several hundred pages per minute are printed and wherein a printing volume of, for example, more than 150,000 pages per month is handled.

Dependent on the type of control employed, an error signal that represents the difference between the actual width and rated width is regulated to the numerical value of "0", or is regulated at least to an optimally low value in terms of amount.

The width of the developing gap can be acquired since the distance between transfer surface and surface of the toner image carrier at the gap is measured at only a single location or in that measurements occur at different locations of the gap and an average is subsequently formed.

In one exemplary embodiment of the invention, at least one further actual width of the gap is acquired at a further location remote from the acquisition location of the first actual width. Subsequently, the further actual width is set in a second closed loop as well as in the above-explained first closed loop. This technique is especially used when the developing gap has a substantial length and greater deviations of the actual width occur over this length. For example, approximately 30 cm or approximately 60 cm are typical lengths of the developing gap.

According to a further aspect, the invention is directed to a printer with which, in particular, the disclosed method of the invention is implemented. The advantageous technical effects cited above also occur given the printer of the invention.

A piezoceramic element is utilized as an adjustment unit in an exemplary embodiment of the invention, as a result whereof extremely short setting times and, thus, low time constants of the control section result. The developing gap is quickly and very exactly set given employment of the piezoceramic element. In particular, complicated mechanical elements for setting the spacing of the two gap limitations are eliminated.

The piezoceramic element can be connected to a developer unit in which a transfer element is contained or can be connected only to the transfer element. When the developer unit employed in the printer allows the entire developer unit need not to be readjusted, then the readjustment of only the essentially lighter transfer element leads to shorter setting times. Moreover, the wear is lower since a substantially smaller mass is moved.

The change in length of the piezoceramic element under the influence of an external electrical field can be preferably canceled since the external field is shut off and the piezoceramic element is pressed back into its initial position with the assistance of a tensile force and/or compressive strain having a predetermined size.

For example, a developer drum is employed as a transfer element. When the developer station contains a toner/air mixture, then toner particles that have a diameter of less than 10 $\mu$m can be applied. The rated width of the gap can be selected smaller than 100 $\mu$m. Particularly given extremely small gap widths, an optimum setting of the developing gap can be achieved by a piezoceramic element that yields an overall stroke or swing of, for example, 200 $\mu$m.

The toner image carrier is drum-shaped in one exemplary embodiment of the invention and is constructed in the fashion of a conveyer belt in another exemplary embodiment. Since the drum-shaped toner image carrier - as a wear part - is not usually fabricated with arbitrary precision for economic reasons, a minimum radial deviation of more than 100 μm unavoidably results. Further deviations result due to imprecisions of the drum receptacle parts. A control of the gap width is thus advantageous. This is also true of conveyor belts that usually run around conveyor drums that are likewise wear parts and have the above-noted errors.

When the acquisition of the actual width occurs with a sensor that works in non-contacting fashion, then no additional wear due to the distance control arises at the toner image carrier.

DESCRIPTION OF THE PREFERRED EMBODIMENTS

Figure 1:
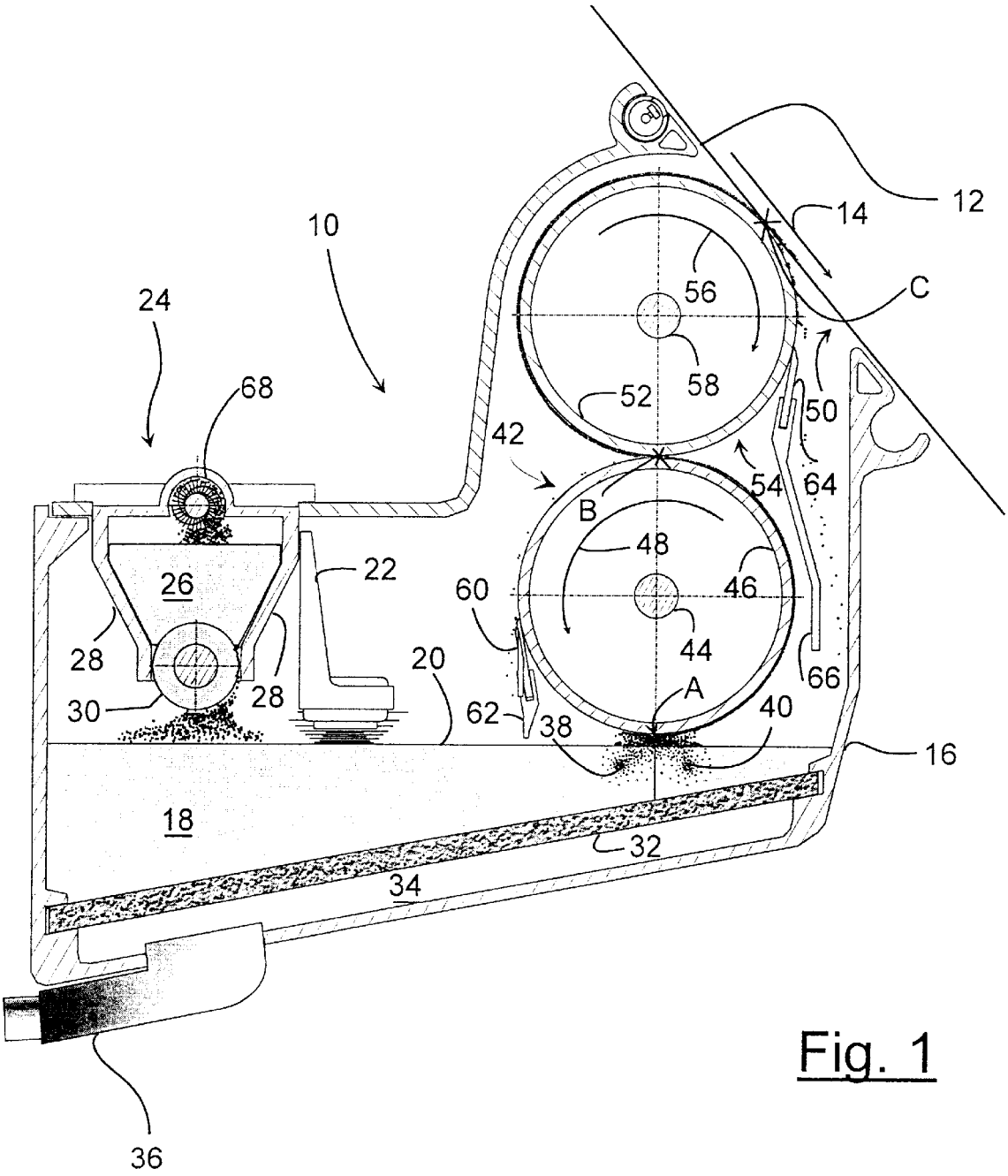
FIG. 1 show the structure of a developer unit in an electro-photographic printer.

FIG. 1 schematically shows the structure of a developer unit 10 past which a photoconductor belt 12 is conducted in the direction of an arrow 14. A latent charge image in which the charges are distributed according to the image information of the image to be printed is located on the photoconductor belt 12 in the surface region facing toward the developer unit 10. In order to simplify the illustration, the conveyor unit for the photoconductor belt 12 was not shown in FIG. 1.

The developer unit 10 contains a container 16 in which a toner/air mixture 18 is located. Toner and air are mixed in the mixture 18 in roughly the ratio 1:10, as a result of which the mixture 18 behaves like a liquid. A boundary surface 20 between the mixture 18 and the air contained in the developer unit 10 is relatively smooth. An ultrasound sensor 22 above the surface 20 acquires a filling level H of the mixture 18.

The mixture 18 is generated from solid toner particles having an average size of approximately 10 μm that are delivered in defined quantities to the toner/air mixture 18 by a toner dosing unit 24. A toner particle supply 26 is located between inclined sidewalls 28 of the toner dosing unit 24, so that the toner particles are delivered in funnel-like fashion to a dosing wheel 30. The dosing wheel 30 has recesses along its circumference into which respectively identical quantities of toner particles are accepted. As a result of a rotational movement of the dosing wheel 30, toner particles are delivered from the inside of the toner dosing unit 24 to the toner/air mixture air 18 as soon as the ultrasound sensor 22 registers a drop of the surface 20 below a predetermined rated height.

An air-permeable plate 32 of a porous polyethylene material is arranged in the floor region of the developer unit 10, the air flowing through this over a large area from a chamber 34 lying under the plate 32 and into the toner/air mixture 18. The chamber 34 is constantly supplied with air through an air delivery connector 36.

Two corona wires 38 and 40 that have a voltage of approximately −8 kV and that negatively charge the toner particles of the mixture 18 in their environment are located in the developer unit 10. The corona wires 38 and 40 proceed through the entire developer unit in a length that approximately corresponds to the expanse of the photoconductor belt 12 transversely relative to the conveying direction 14 thereof. A transfer drum 42 with an axis 44 of which proceeds parallel to the corona wires 38 and 40 is arranged above the corona wires 38 and 40 and above the surface 20. A conductive surface layer 46 has a potential of about −0.9 kV, so that the generated, negative toner particles over the entire length of the corona wires 38 and 40 are deposited on the surface layer 46 in response to the effect of the electrical field between the corona wires 38, 40 and the transfer drum 42. Given a rotation of the transfer drum 42 in the direction of an arrow 48, the deposited toner particles are conveyed in the direction of an opening 50 of the developer unit 10 for delivery of toner particles. The conveying path of the charged toner particles for the section shown in FIG. 1 proceeds through the developer unit 10 along the outside radius of the transfer drum 42 from a Point A up to a Point B.

In Point B, the toner particles are transferred onto a conductive surface layer 52 of a developer drum 54 under the influence of a further electrical field, this developer drum 54 rotating in the direction of an arrow 56. The further electrical field lies between the surface layer 46 and the surface layer 52 charged to a potential of about −0.5 kV. The axis 58 of the developer drum 54 is arranged essentially parallel to the axis 44. For the section shown in FIG. 1, the toner particles—after being transferred in the Point B—are conveyed by the developer drum 54 along the outside radius of the developer drum 54 to a Point C in the opening 50.

Isolated toner particles that were not transferred from the transfer drum 42 to the developer drum 54 are removed from the surface layer 46 with the assistance of a stripper 60 before the respective region of the surface layer 46 is covered again with new charged, toner particles. The stripper 60 proceeds over the entire length of the transfer drum 42 and is held by a stripper holder 62.

The latent charge image of the photoconductor belt 12 is developed in the region of the opening 50 in that toner particles from the surface layer 52 agglomerate in charged regions of the photoconductor belt 12. Toner particles remaining on the developer drum 54 are removed from the surface layer 52 by a further stripper 64 before new toner particles are again applied from the transfer drum 42. The stripper 64 proceeds over the entire length of the developer drum 54 and is held by a further stripper holder 66 that is also a baffle unit for the toner particles detaching from the toner drum 54 at the same time. The toner particles removed by the strippers 60 and 64 fall back into the mixture 18.

Toner that replaces the toner particles used during developing is supplied to the developer unit by a toner delivery unit 68.

Figure 2:
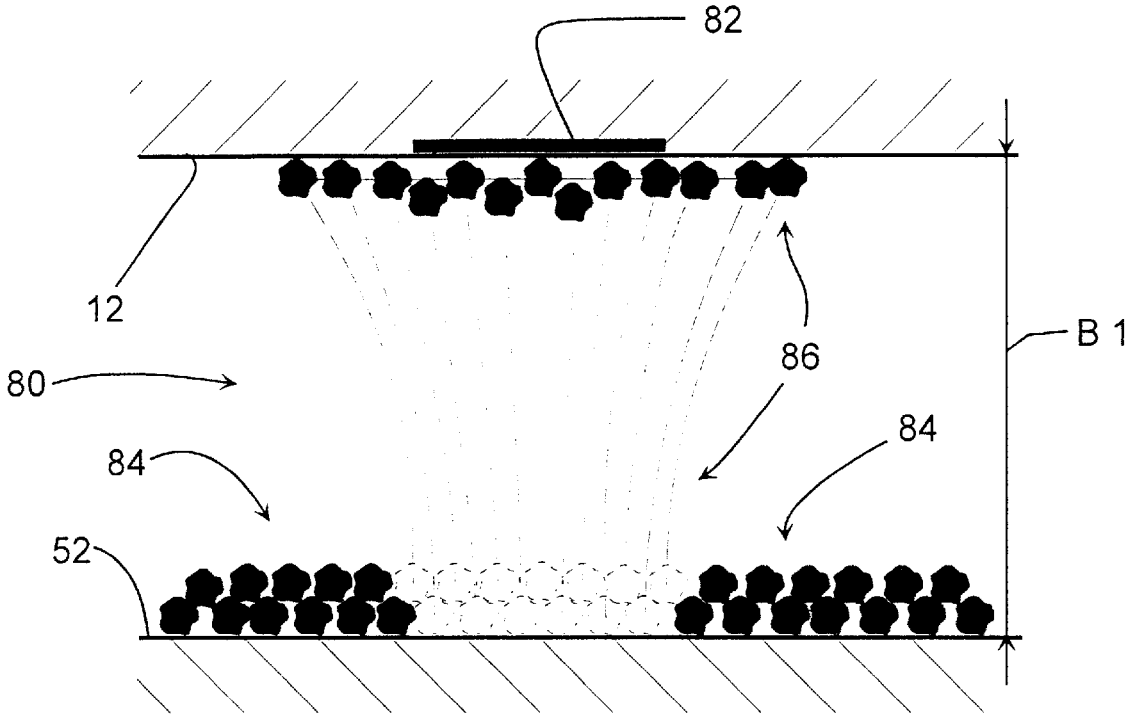
FIG. 2 illustrates operations during developing with a toner in the region of a developing gap.
Figure 2:
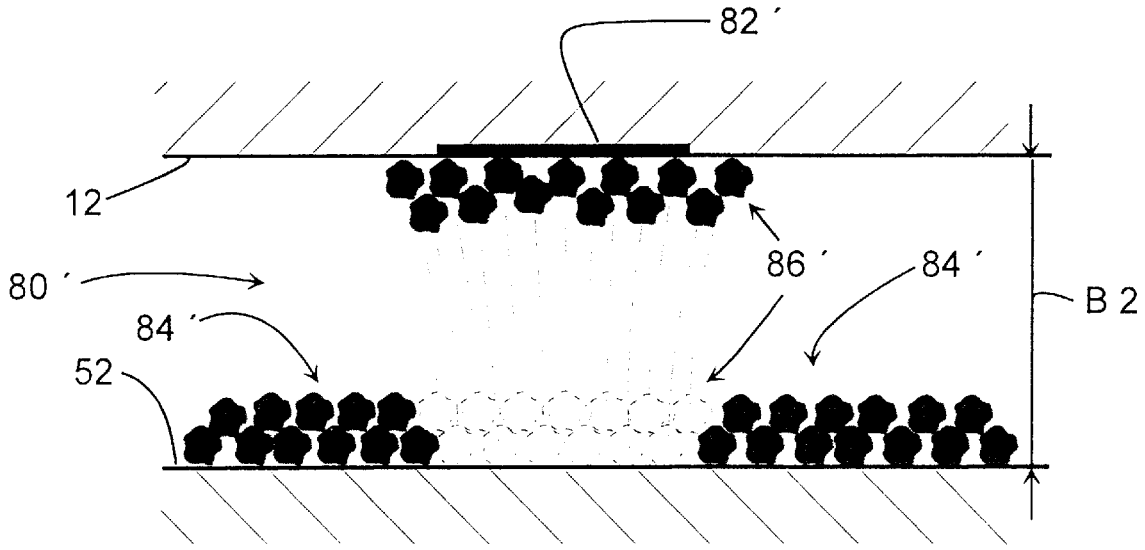

In a part "a" of the illustration, FIG. 2 shows the operations when developing in the region of a developing gap 80 between the photoconductor 12 and the surface layer 52 according to FIG. 1. The photoconductor belt 12 has a spacing B1 from the surface layer 52 in the region of the gap 80, this spacing B1 being equal to the gap width of the gap 80. A positively charged part 82 of the latent charge image is located in the surface region of the photoconductor belt 12. Of toner particles 84 and 86 on the surface layer 52, only the toner particles 86 will jump over the gap 80 due to the field between surface layer 52 and positively charged part 82. During the flight through the gap 80, the toner particles 86 mutually influence one another. Since the toner particles 86 are charged with potentials having the same operational sign, a repulsion occurs. The consequence is that the toner particles 86 deposit not only in the region of the positively charged part 82 but also in the proximity thereof, so that the quality of an arising print image ultimately declines.

Part "b" of FIG. 2 shows the operations at the developing gap 80' that differs from the developing gap 80 only in that its width B2 is smaller than the width B1.

Of toner particles 84' and 86'—similar to part A of FIG. 2—, only the toner particles 86' that lie opposite a positively charged part 82' on the photoconductor belt 12 are transferred from the surface layer 52 to the photoconductor belt 12. Due to the smaller spacing B2 compared to the spacing B1, the toner particles 86' influence one another less during the transfer than the toner particles 86 in part a of FIG. 2. The result is that the toner particles 86' in the edge region of the positively charged part 82' distance themselves to a lesser extent from the part 82' than toner particles in the edge region of the positively charged part 82 according to part a of FIG. 2. Ultimately, the print image has a higher quality given the spacing B2.

The gap width B1 or B2 must be held constant during the printing process in order to prevent a fluctuation of the quality of the print image. Fluctuations of the gap width B1 or B2 result, among other things, from imperfections of the conveyor means for the photoconductor belt 12 as well as from manufacturing tolerances during manufacture of the developer drum 54.

Figure 3:
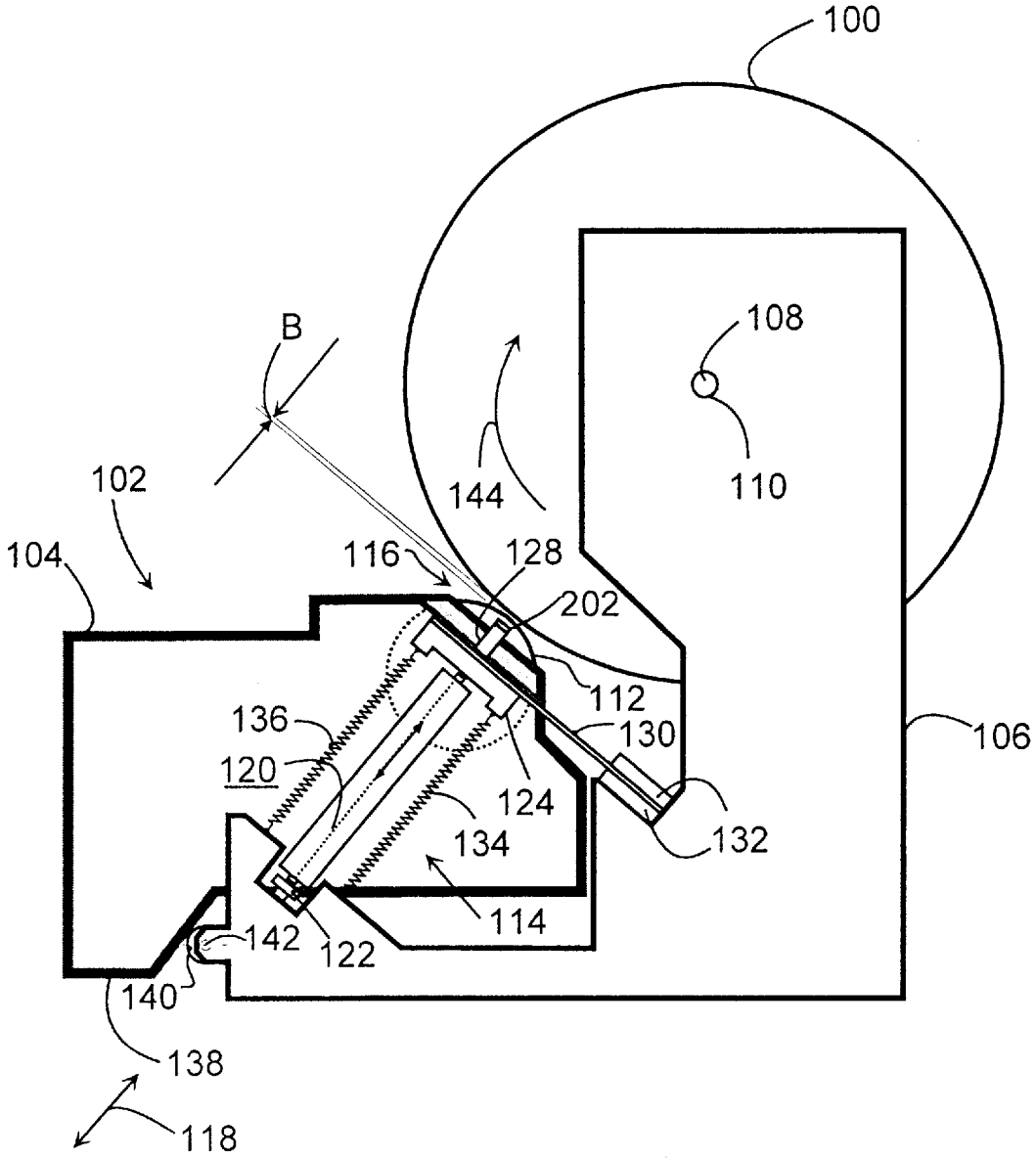
FIG. 3 shows a developer unit that is displaceably seated relative to a photoconductor drum.

FIG. 3 shows a developer unit 102 seated displaceable relative to a photoconductor drum 100 that is constructed essentially like the developer unit 10. Only the form of the container 16 (see FIG. 1) is modified given a container 104. The modifications derive from the following description.

Photoconductor drum 100 and developer unit 102 are seated in a frame 106 of an electrophotographic printer. The photoconductor drum 100 has its shaft rotatably seated at the face ends in receptacles 110. The developer unit 102 is likewise connected to the frame 106 at both sides in the region of the face ends of a developer drum 112, being connected thereto via two holder mechanisms of which only one holder mechanism 114 is shown in FIG. 3.

A developing gap 116 having a gap width B lies between the surface of the photoconductor drum 100 and the surface of the developer drum 112. The width B at the developing gap 116 can be set by displacing the developer unit 102 in the direction of the normal of the surface of the photoconductor drum 100. The direction of the normal and the direction opposite thereto are illustrated by a double arrow 118. The displacement of the developer unit 102 occurs on the basis of a piezoceramic element 120 when this is driven with a voltage USTELL. At its one end, the element 120 is seated in a fixed bearing 122 that is secured to the frame 106. At its other end, the element 120 is seated in a fixed bearing 124. This fixed bearing 124 is rigidly connected to the developing unit 120 and to a leaf spring 130. The other end of the leaf spring 130 is connected to the frame 106 by a mount 132. The leaf spring 130 allows a play-free movement of the developer unit 102 in normal direction 118 and essentially prevents a movement of the developer unit 102 in a tangential direction relative to the surface of the photoconductor drum at the developing gap 116.

Restoring springs 134 and 136 are also secured to the fixed bearing 124, their other ends being connected to the frame 106 so that the developer unit is pulled away from the photoconductor drum 100 after the deactivation of the voltage at the element 120. The gap width B thus increases. The movement of the developer unit 102 is promoted by a guide surface 138 at the developer unit 102 that is inclined in normal direction 118 and on which a loosely seated roller 140 lies. The roller 140 has its shaft 142 seated at both sides at the frame 106. Atlernatively, the gap width B is set by use of a cam plate driven by a stepper motor.

During developing, the photoconductor drum 100 rotates in the direction of an arrow 144, whereby the latent charge image at the developer drum 112 applied by an exposure unit (not shown) is conveyed past. The gap width B is thereby held essentially constant by the control described below.

Figure 4:
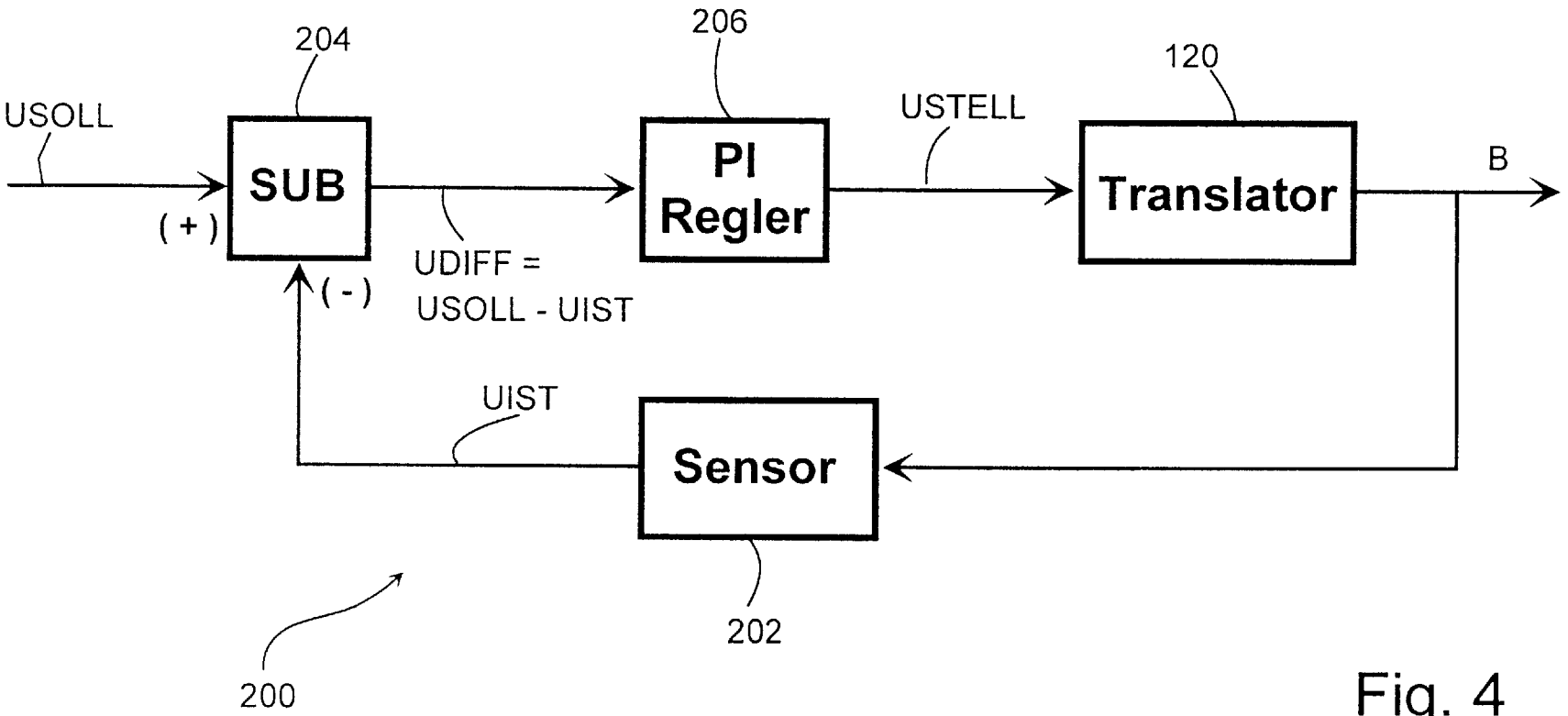
FIG. 4 shows a schematic illustration of a control circuit for controlling the width of the developing gap.

FIG. 4 shows a schematic illustration of a control unit 200 for controlling the width B of the developing gap 116 according to FIG. 3.

As an actuator, the control unit 200 contains the piezoceramic element 120 (also see FIG. 3) that sets the width B dependent on the voltage USTELL at its input lines. The width B is acquired in non-contacting fashion with the assistance of a sensor 202 that works according to the eddy current measuring principle. The sensor 202 outputs a voltage UIST at its outputs that is a correct measure for the width of the gap B.

The actual voltage UIST is subtracted from a rated voltage USOLL in a subtracter 204, this rated voltage USOLL corresponding to a predetermined width B. A difference voltage UDIFF=USOLL−UIST from which an adjustment voltage USTELL is generated in a PI regulator 206 is present at the output of the subtracter 204. The PI regulator 206 generates the setting voltage USTELL such that the difference voltage UDIFF is reduced inside overtime and ultimately corresponds to a voltage of "0 V". In this case, the actual width B in the developing gap 116 (see FIG. 3) coincides with the rated width prescribed by the rated voltage USOLL until the width B again deviates from the rated width due to the aforementioned influences, and the control procedures begins anew.

Although various minor changes and modifications might be proposed by those skilled in the art, it will be understood that our wish is to include within the claims of the patent warranted hereon all such changes and modifications as reasonably come within our contribution to the art.

We claim as our invention:

1. A printer, comprising:

a toner image carrier at a surface region of which a charge image to be developed is located;

a developer unit for transferring toner onto the toner image carrier with assistance of a transfer element at a developing gap;

at least one sensor for acquiring an actual width of the developing gap that changes during transfer of the toner;

a control unit for comparison of actual width to a predetermined rated width;

a setting unit driven by the control unit for setting the width of the gap dependent on a comparison result; and the setting unit containing a cam plate driven by a stepping motor.

2. A printer comprising a toner image carrier at a surface region of which a charge image to be developed is located;

a developer unit for transferring toner onto the toner image carrier with assistance of a transfer element at a developing gap;

at least one sensor for acquiring an actual width of the developing gap that changes during transfer of the toner;

a control unit for comparison of actual width to a predetermined rated width;

a setting unit driven by the control unit for setting the width of the gap dependent on a comparison result; and the setting unit containing a piezoceramic element.

3. The printer according to claim 2 wherein the piezoceramic element is seated between two retainer elements, the one retainer element being secured to a frame and the other retainer element being connected to the developer unit and to the transfer element.

4. The printer according to claim 3 wherein a tensile force and compressive strain of a predetermined size acts on at least one of the retainer elements.

5. A printer comprising a toner image carrier at a surface region of which a charge image to be developed is located;

a developer unit for transferring toner onto the toner image carrier with assistance of a transfer element at a developing gap;

at least one sensor for acquiring an actual width of the developing gap that changes during transfer of the toner;

a control unit for comparison of actual width to a predetermined rated width;

a setting unit driven by the control unit for setting the width of the gap dependent on a comparison result; and the developer unit and the transfer element being seated displaceably substantially in a direction of a normal of the surface region of the toner image carrier at the developing gap, the developer unit being guided along the normal by at least one guide element.

6. The printer according to claim 5 wherein the guide element is formed by a surface of the developer unit that lies on at least one roller member and that proceeds substantially in a direction of the normal.

7. The printer according to claim 5 wherein the guide element is a leaf spring that has one end secured to a frame and has the other end secured to the developer unit.

8. A printer, comprising:

a toner image carrier at a surface region of which a charge image to be developed is located;

a developer unit for transferring toner onto the toner image carrier with assistance of a transfer element at a developing gap;

at least one sensor for acquiring an actual width of the developing gap that changes during transfer of the toner;

a control unit for comparison of actual width to a predetermined rated width;

a setting unit driven by the control unit for setting the width of the gap dependent on a comparison result; and the rated width being smaller than substantially 100 $\mu$m.

9. A printer, comprising:

a toner image carrier at a surface region of which a charge image to be developed is located;

a developer unit for transferring toner onto the toner image carrier with assistance of a transfer element at a developing gap;

at least one sensor for acquiring an actual width of the developing gap that changes during transfer of the toner;

a control unit for comparison of actual width to a predetermined rated width;

a setting unit driven by the control unit for setting the width of the gap dependent on a comparison result; and the actual width being acquired close to an edge region of the toner image carrier; and at least one further actual width being acquired close to an opposite edge region of the toner image carrier so that the further actual width is a controlled quantity in a further control circuit.

10. A printer, comprising:

a toner image carrier at a surface region of which a charge image to be developed is located;

a developer unit for transferring toner onto the toner image carrier with assistance of a transfer element at a developing gap;

at least one sensor for acquiring an actual width of the developing gap that changes during transfer of the toner;

a control unit for comparison of actual width to a predetermined rated width;

a setting unit driven by the control unit for setting the width of the gap dependent on a comparison result; and the toner image carrier comprising a circulating conveyor belt.

* * * * *